United States Patent [19]

Naffziger

[11] 4,410,044

[45] Oct. 18, 1983

[54] METHOD FOR ORIENTING WELL CASING AND OTHER TUBULAR WORK OBJECTS AND DEVICE THEREFOR

[76] Inventor: Larry C. Naffziger, 3091 N. Monroe, Fresno, Calif. 93711

[21] Appl. No.: 302,539

[22] Filed: Sep. 16, 1981

Related U.S. Application Data

[63] Continuation-in-part of Ser. No. 282,395, Jul. 13, 1981, Pat. No. 4,382,470.

[51] Int. Cl.[3] ..... E21B 19/16

[52] U.S. Cl. ..... 166/379; 166/380; 166/382; 166/75 R

[58] Field of Search ..... 166/77.5, 82, 86, 88, 166/208, 378, 379, 380, 382, 75 R; 175/321, 215, 171, 173; 285/133 A, 140, 142; 29/237, 455 R, 525

[56] References Cited

U.S. PATENT DOCUMENTS

| | | | |
|---|---|---|---|
| 2,850,246 | 9/1958 | Grable | 285/133 A |
| 3,273,646 | 9/1966 | Walker | 166/86 |
| 3,677,355 | 7/1972 | Elenburg | 175/215 |

*Primary Examiner*—Stephen J. Novosad

*Assistant Examiner*—Joseph Falk

*Attorney, Agent, or Firm*—Huebner & Worrel

[57] ABSTRACT

A method for orienting well casing and other tubular work objects of differing transverse dimension relative to each other including the steps of positioning the work objects telescopically relative to each other in such a manner that when the work object of larger transverse dimension is disposed in a substantially vertical attitude, the work object of smaller transverse dimension is pendantly supported gravitationally substantially to self center along a common axis with the work object of larger transverse dimension; disposing the work object of larger transverse dimension in a substantially vertical attitude; and mounting the work objects in fixed relation relative to each other. A device including a member mounted within the work object of larger transverse dimension defining a first plane substantially right-angularly related to the longitudinal axis of the work object of larger transverse dimension and a member mounted externally of the work object of smaller transverse dimension defining a second plane substantially right-angularly related to the longitudinal axis of the work object of smaller transverse dimension.

3 Claims, 2 Drawing Figures

METHOD FOR ORIENTING WELL CASING AND OTHER TUBULAR WORK OBJECTS AND DEVICE THEREFOR

CROSS-REFERENCE TO A RELATED PATENT APPLICATION

This patent application is a continuation-in-part of prior copending patent application Ser. No. 282,395, filed July 13, 1981 now U.S. Pat. No. 4,382,470 and entitled "Method And Well Casing".

BACKGROUND OF THE INVENTION

1. Field of the Invention

The present invention relates to a method for orienting well casing and other tubular work objects and a device therefor and more particularly to such a method and device having particular utility when employed in conjunction with the method and well casing of the applicant's copending patent application Ser. No. 282,395, filed July 13, 1981, now U.S. Pat. No. 4,382,470.

As set forth in the applicant's aforementioned copending patent application Ser. No. 282,395, filed July 13, 1981, the disclosure of which is herein incorporated by reference, the invention of that application affords the capability of maintaining well productivity at a high level while minimizing the energy requirements for maintaining such a level of production and permits fluid to be pumped from two or more fluid bearing formations simultaneously without modification or repositioning of the pump assembly and without risk of destruction of the pump assembly as a result of entrapped air. The method thereof may be characterized by establishing a pair of passages in communication with a fluid bearing formation and pumping fluid along the pair of passages as described and claimed therein. This is accomplished in the preferred embodiment of that application by the use of a double walled well casing constructed, in part, from a pair of substantially concentric walls, the outer one of which is perforated adjacent to its upper extremities to communicate with the formation and the inner one of which communicates with the formation at its lower end portion and with the interior of the outer wall below the perforations thereof.

2. Description of the Prior Art

Conventional techniques for orienting work objects and, in particular, for orienting conventional well casing are less than satisfactory when applied to the well casing of the applicant's aforementioned invention. Conventional practice in installing conventional well casing calls for the casing to be assembled in sections of twenty to forth foot lengths. A first section is supported in the borehole with its upper end portion at the earth surface. Thereafter, a second section is lowered using a crane and slipped into the collar of the upper end portion and welded in position. Subsequently, the two welded sections are lowered into the borehole until the upper end portion of the second section is at the earth surface. Succeeding sections of well casing are then successively positioned in their respective preceding sections, welded in position and lowered into the borehole until a casing of the length required has been assembled.

This method is not satisfactory in installing the double walled casing of the applicant's invention. Conventional techniques would require that the inner wall be mounted in position first and the outer wall then be suspended over the inner wall and moved downwardly thereabout and into position for mounting on its respective preceding section. Since the inner and outer walls may total in length from forty to eighty feet in the aggregate, it would be necessary to use quite heavy duty and very large equipment including a very tall crane to maneuver the outer wall over and then downwardly about the inner wall. This is both cumbersome in operation and quite expensive in view of the size of the equipment involved and the time and manpower required.

Therefore, the present invention is directed to providing an improved method and device for orienting well casing and other tubular work objects having particular utility in the installation of the well casing of the applicant's aforementioned invention.

SUMMARY OF THE INVENTION

Therefore, it is an object of the present invention to provide an improved method and device for orienting well casing and other tubular work objects.

Another object is to provide such a method and device which permit tubular work objects to be oriented relative to each other expeditiously and with a precision not heretofore achieved.

Another object is to provide such a method and device which have particular utility when employed in conjunction with the method and well casing of the applicant's copending patent application Ser. No. 282,395, filed July 13, 1981.

Another object is to provide such a method which facilitates the installation of well casing without the use of very large and expensive equipment.

Another object is to provide such a method which operates to achieve orientation of an inner well casing along a substantially vertical axis automatically during the installation process, which simultaneously positions the inner well casing in substantially coaxial alignment with the outer well casing and which subsequent to mounting of the inner well casing in the borehole operates to guide the outer well casing into position for mounting.

Another object is to provide such a method which is operable to install successive sections of double walled well casing by repeating the steps of the method.

Another object is to provide such a device which operates automatically to position tubular work objects of differing transverse dimensions relative to each other, and in particular the double walled well casing of the applicant's aforementioned invention, without interfering with the operation of such well casing once installed.

Another object is to provide such a device which operates to support one well casing relative to another; to support one of the well casings in a substantially vertical attitude when the other casing is supported in a substantially vertical attitude; to position the well casings in substantially concentric, coaxial alignment; and to guide movement of the inner and outer well casings relative to each other during the installation process.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
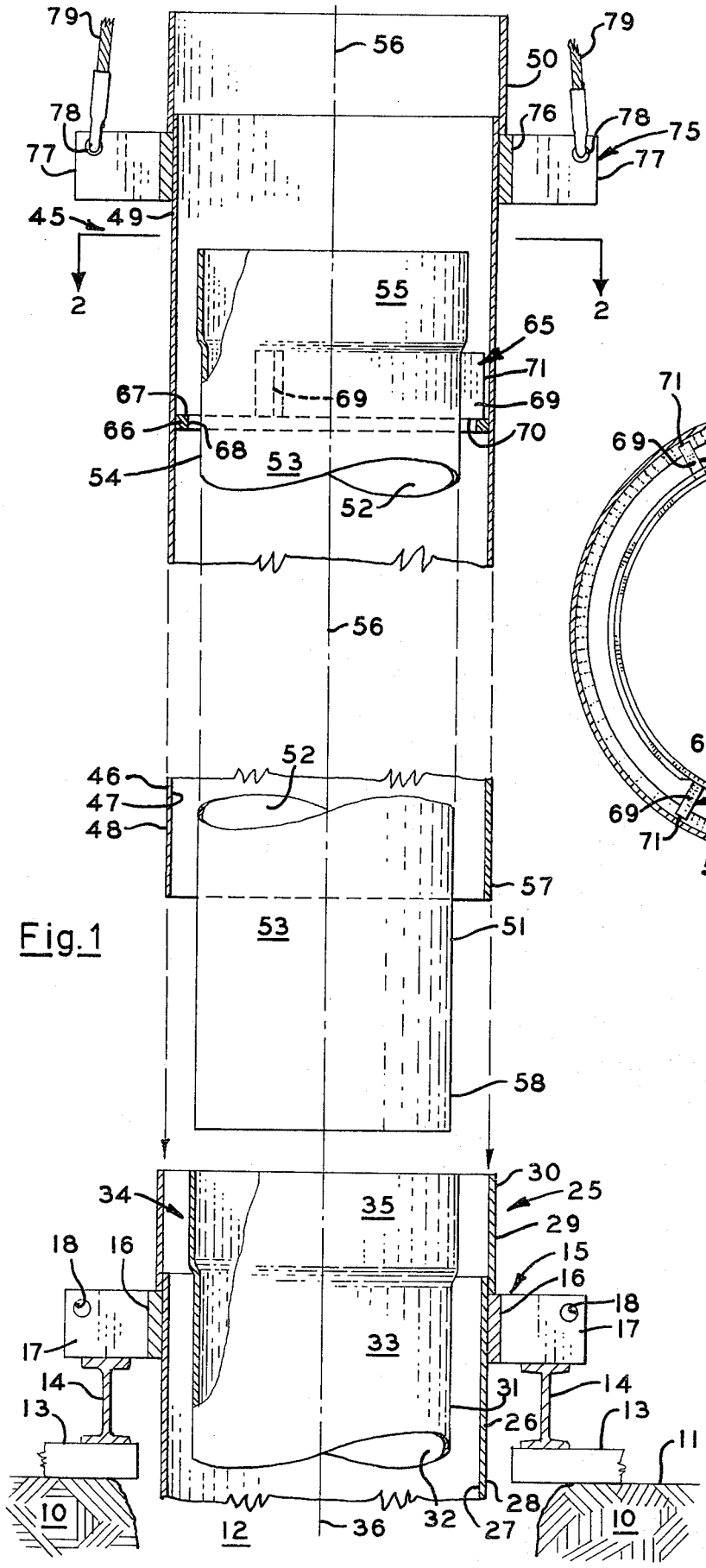
FIG. 1 is a fragmentary longitudinal section of a well casing of the applicant's aforementioned patent application being installed in accordance with the method of the applicant's instant invention and showing the device of the applicant's instant invention.
Figure 2:
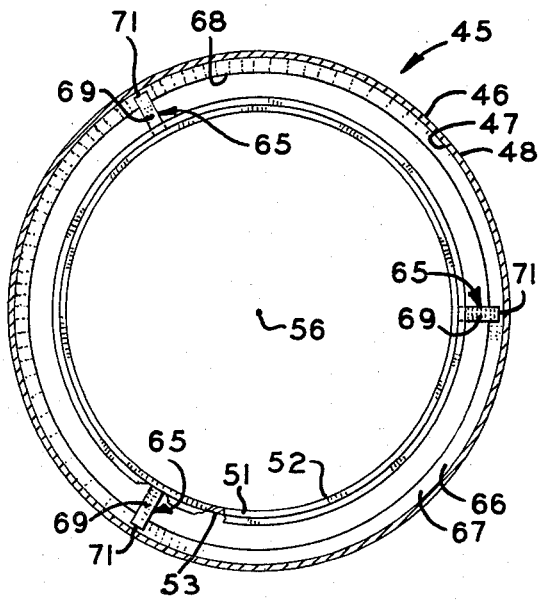
FIG. 2 is a somewhat enlarged, fragmentary transverse section taken from a position indicated by line 2—2 in FIG. 1.

The practice of the method of the present invention is illustrated in FIG. 1 where the earth is indicated at 10 and the earth surface at 11. A borehole 12 has been formed extending into the earth. For illustrative convenience, the platform of a drilling rig is indicated at 13. It will be understood that in the normal course, the drilling rig, only partially shown in FIG. 1, is employed in the drilling of the borehole 12. The drilling rig platform is thereafter available for installation of the well casing in the borehole, although, it is not essential that the platform be used for this purpose.

A pair of I-beams 14 are individually rested on the drilling platform 13 in spaced relation to each other on opposite sides of the borehole 12. A yoke 15 of conventional design is rested on the I-beams as shown in FIG. 1 extending over the borehole. The yoke has a hinged ring 16 which can be opened to insert or remove casing from therewithin. Alternatively, the hinged ring can be closed and locked in position circumscribing the casing. A pair of flanges 17 are mounted on opposite sides of the hinged ring, each flange having a hole 18 therein.

In accordance with the method and well casing of the applicant's aforementioned copending patent application Ser. No. 282,395, filed July 13, 1981, a section of double walled casing is installed in the borehole 12. Such an assembled section of double walled casing is indicated at 25 in FIG. 1. It will be understood that the section shown at 25 in FIG. 1 can be the lower portion of the double walled casing which is preferably preassembled at the factory and which has an outer casing which joins an inner casing by way of a cone structure, not shown. Alternatively, the assembled section of double walled casing 25 shown in FIG. 1 can be simply a preceding section of double wall casing assembled in accordance with the method hereinafter to be described. In this latter instance, it will be understood that the preassembled section having the cone structure would be at the lower end of the assembled section of double walled casing 25 in accordance with the preferred embodiment of the applicant's invention of the aforementioned prior patent application.

The assembled section of double walled casing 25 has an outer casing or wall 26 having an interior surface 27 and an exterior surface 28. The outer casing has an upper end portion 29 having a collar 30 disposed in upwardly facing relation for the receipt of the next successive outer casing. The assembled section of double walled casing 25 has an inner casing or wall 31 having an interior surface 32 and an exterior surface 33. The inner casing has an upper end portion 34 having a collar 35 upwardly disposed for the receipt of the next successive inner casing. It will be understood that the outer and inner casings 26 and 31 are rigid relative to each other by such preassembly. The assembled section of double walled casing is retained in supported relation extending approximately 3 feet above the borehole by the yoke 15 circumscribing the outer casing 26 and engaging the underside of the collar 30. The flanges 17 of the yoke, in turn, are rested on the I-beams 14 on the platform 13 of the drilling rig. Thus, the assembled section of double walled casing is securely retained in position by the yoke, but is free to be lowered into the borehole upon removal of the yoke from the outer casing.

The outer casing 26 and inner casing 31 are substantially concentric to a common longitudinal axis 36.

A second or unassembled section of double walled casing is indicated at 45 in FIG. 1. The unassembled section of double walled casing has a tubular work object or outer casing or wall 46 having an interior surface 47 and an exterior surface 48. The outer casing has an upper end portion 49 having a collar 50 adapted slidably to receive the end portion of a next successive outer casing.

The second or unassembled section of double walled casing 45 has a tubular work object or inner casing or wall 51 with an interior surface 52 and an exterior surface 53. The inner casing has an upper end portion 54 having a collar 55 adapted slidably to receive an end portion of a next successive inner casing. As shown in FIG. 1, the outer casing 46 and inner casing 51 are disposed substantially concentric to a longitudinal axis 56. The outer casing 46 has a lower end portion 57. The inner casing 51 has a lower end portion 58. The lower end portions 57 and 58 of the outer and inner casings are dimensioned slidably to be received in the collars 30 and 35 respectively of the outer casing 26 and inner casing 31. The outer and inner casing can, of course, be of any desired length. However, the outer and inner casings are normally each thirty feet in length. Similarly, the diameters of the outer and inner casings can be such as desired, but in the preferred embodiment the outer casing is twenty inches in diameter and the inner casing sixteen inches in diameter.

The device of the present invention useful in the practice of the method hereof is indicated at 65 in FIG. 1. The device 65 has a member or ring 66 secured, as by welding, on the interior surface 47 of the outer casing 46 preferably concentric to the longitudinal axis 56 and spaced inwardly of the upper end portion 49 of the outer casing a distance of approximately 3 feet in the preferred embodiment. It will be understood, however, that this distance is not critical, although it is preferred that the ring be adjacent to the upper end portion of the outer casing. The ring has an upper surface 67 defining a plane right-angularly related to the longitudinal axis 56. The ring has an annular inner surface 68 which is preferably spaced from the interior surface 47 of the outer casing a distance of approximately one half inch.

The device 65 includes three stops 69 secured, as by welding, on the exterior surface 53 of the inner casing 51 immediately adjacent to the collar 55 of the inner casing and substantially equally spaced about the periphery of the exterior surface 53 of the inner casing. The stops have undersides or lower surfaces 70 which define a plane which is right-angularly related to the longitudinal axis 56 as shown in FIG. 1. Each of the stops has a guide surface 71. The length of the stops is such that the guide surfaces 71 of the stops, when the inner casing is concentric to the outer casing 46 as shown in FIG. 1, are spaced from the interior surface 47 of the outer casing a minimal distance such as one eighth of an inch. Thus, the positioning of the interior casing within the outer casing 46 operates, by way of the stops, virtually precisely to position the inner casing concentric to the longitudinal axis 56 while at the same time permitting the casing to be suspended on the member 66 in nearly free swinging relation.

As shown in FIG. 1, the second or unassembled section of double walled casing 45 is suspended on a yoke 75 identical to yoke 15 already described. The yoke has a hinged ring 76 extending circumferentially about the upper end portion 49 of the outer casing 46 in abutted relation with the collar 50 of the outer casing. A pair of flanges are mounted on the hinged ring extending in opposite directions and individually having holes 78 therein. The yoke, in turn, is suspended on a pair of suspension cables 79. It will be understood that the cables are supported on a crane or similar device capable of moving the unassembled section of double walled casing to the precise position desired.

OPERATION

The operation of the method and device of the present invention is believed to be clearly apparent and is briefly summarized at this point. As we previously discussed, the assembled section of double walled casing 25 is supported in the borehole 12 by the yoke 15 rested on the I-beams 14 so that the upper end portions 29 and 34 respectively of the outer and inner casings 26 and 31 are above the earth surface 11.

In accordance with the practice of the method hereof, the inner casing 51 of the unassembled section of double walled casing 45 is inserted within the outer casing 46 by extension of the lower end portion 58 of the inner casing through the upper end portion 49 of the outer casing and through the ring 66 of the device 65. The outer and inner casings are telescopically disposed with respect to each other until the stops 69 engage the ring 66, as shown in FIG. 1. In this position, the lower surfaces 70 of the stops 69 are disposed in facing engagement with the upper surface 67 of the ring 66. Subsequently, the outer and inner casings 46 and 51 are positioned in the yoke 75 and supported on the suspension cables 79, as shown in FIG. 1. This causes the outer casing 46 to be supported so that the longitudinal axis 56 is substantially vertical. Consequently, the engaged lower surfaces 70 of the stops 69 and the upper surface 67 of the ring 66 retain the inner casing 51 vertically oriented. The guide surfaces 71 of the stops operate to maintain the inner casing concentric to the outer casing and in coaxial relation along the longitudinal axis 56. As can be visualized in FIG. 1, the lower end portion 58 of the inner casing 51 is nonetheless substantially free to swing gravitationally as the outer casing is positioned so that any misalignment which might occur is quickly adjusted. Similarly, since the outer and inner casings are the same length, the lower end portion of the inner casing extends approximately three feet out the lower end portion 57 of the outer casing.

Thereafter, using the crane not shown, the outer casing 46 with the inner casing 51 so suspended therein, is positioned over the borehole 12 so that the longitudinal axis 36 of the assembled section of double walled casing 25 is coincident with the longitudinal axis 56 of the outer and inner casings 46 and 51, as shown in FIG. 1. The crane is then operated to lower the outer casing and thus the lower end portion 58 of the inner casing until the lower end portion 58 slides into the collar 35 of the inner casing 31 of the assembled section of double walled casing 25. Since the device 65 is concentric to the longitudinal axis 56 and since the longitudinal axes 56 and 36 are coincident, such slidable interconnection of the lower end portion 58 in the collar 35 is easily accomplished. Subsequently, the lower end portion 58 and collar 35 are welded to each other forming a fluid tight bond.

Since the assembled section of double walled casing 25 is securely retained in the position described, once such welding of the lower end portion 58 of the inner casing 51 in the collar 35 is accomplished, the inner casing 51 is supported by the assembled section of double walled casing 25 so that the axes 36 and 56 are coincident.

Thereafter, in accordance with the practice of the method hereof, the crane, not shown is operated so as to lower the yoke 75 and thus the outer casing 46 borne thereby along a path concentric to the longitudinal axis 56. The ring 66 of the device 65 is thus effectively drawn away from the lower surfaces 70 of the stops 69 as the outer casing 46 is moved toward the collar 30 of the outer casing 26. During such movement, the guide surfaces 71 of the stops 69 operate to guide the outer casing along the described path by slidable engagement with the interior surface 47 of the outer casing 46. Such movement is continued until the lower end portion 57 of the outer casing is fully slidably received in the collar 30 of the outer casing 26.

Subsequently, the lower end portion 57 of the outer casing 46 is welded on the collar 30 of the outer casing 26 so as to form a permanent fluid tight bond. When such welding has been completed, both the outer casing 46 and inner casing 51 are an integral part of the outer casing 26 and inner casing 31 respectively and are rigid relative to each other. Thus, the first and second sections 25 and 45 are of unitary construction forming a portion of the double walled casing of the invention of the applicant's aforementioned patent application.

The crane, not shown, is then operated to raise both the first and second sections 25 and 45 respectively a short distance. This raises the flanges 17 of the yoke 15 from the I-beams 14. The yoke 15 is then removed from the outer casing 26 and the crane is operated to lower the first and second sections 25 and 45 into the borehole 12 until the flanges 77 of the yoke 75 are rested on the I-beams 14. Thereafter, the process heretofore described can be repeated to install a third section of double walled casing and as many subsequent sections as may be desired.

If it is desired to construct the double walled casing so as to have a sealed upper end for the double walled portion of the casing as shown in the preferred embodiment of the applicant's foregoing copending patent application, an inner casing of the same diameter as the casings 31 and 51 is employed. An inverted cone shaped housing is slidably received about the inner casing. Thereafter, the casing is mounted, by welding, on the next preceding inner casing as heretofore described. Subsequently, the inverted cone is welded on the next preceding outer casing 46 as heretofore described and the convergent end portion of the inverted cone is subsequently welded on the exterior surface of that inner casing. Thus, a chamber is formed between the inner and outer casing about the inner casing confined between the cones at opposite ends thereof. It will be understood that the sections of inner and outer casing contain the openings described in the applicant's copending patent application in accordance with the invention thereof though such openings are not shown, for illustrative convenience, in the drawing hereof.

Therefore, the method for orienting well casing and other tubular work objects and device therefor of the present invention permit such well casing to be installed precisely, efficiently and inexpensively in a borehole without the use of very large and expensive equipment, to do so without interfering with the operation thereof once installed and have application to orienting other tubular work objects relative to each other.

Although the invention has been herein shown and described in what is conceived to be the most practical and preferred method and device, it is recognized that departures may be made therefrom within the scope of the invention, which is not to be limited to the illustrative details disclosed.

Having described my invention, what I claim as new and desire to secure by Letters Patent is:

1. A method for installing sections of well casing in a borehole comprising the steps of:

A. supporting a first section of well casing, having inner and outer walls, in the borehole with end portions of said walls adjacent to the earth surface;

B. suspending a second section of well casing, having inner and outer walls, over the borehole and in substantial axial alignment with said end portions of said walls of the first section and with the inner wall of the second section suspended from and within the outer wall of the second section with a lower end portion of the inner wall extending therefrom in the direction of the borehole;

C. mounting the lower end portion of the inner wall of the second section on the end portion of the inner wall of the first section in substantial axial alignment therewith;

D. sliding the outer wall of the second section downwardly about the inner wall of the second section;

E. mounting the outer wall of the second section on the end portion of the outer wall of the first section in substantial axial alignment therewith; and F. lowering said first and second sections into the borehole.

2. The method of claim 1 wherein the lowering step includes supporting end portions of said second section adjacent to the earth surface after said lowering step and the method includes the step of:

G. mounting a third section of well casing on said end portions of the second section.

3. The method of claim 1 wherein in the suspending step the inner wall of the second section is pendantly supported on and within the outer wall of the second section substantially concentric thereto in such a manner as to be gravitationally self centering therewithin.

* * * * *